US007311583B2

(12) United States Patent
Jagaric et al.

(10) Patent No.: US 7,311,583 B2
(45) **Date of Patent: *Dec. 25, 2007**

(54) BREAST PAD CONSTRUCTION FOR A GARMENT

(75) Inventors: Andrea Jagaric, New York, NY (US); Nathalie Martinet, New York, NY (US); Judith Grigor, New York, NY (US); Bull Lau, Kwai Chung (HK)

(73) Assignee: Victoria's Secret Stores Brand Management, Inc., Reynoldsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/236,894

(22) Filed: Sep. 28, 2005

(65) Prior Publication Data

US 2006/0030238 A1 Feb. 9, 2006

Related U.S. Application Data

(63) Continuation-in-part of application No. 11/054,185, filed on Feb. 9, 2005, now Pat. No. 6,997,775, which is a continuation-in-part of application No. 10/804,403, filed on Mar. 19, 2004, now Pat. No. 7,052,360, and a continuation-in-part of application No. 10/911,269, filed on Aug. 4, 2004, now Pat. No. 6,986,696.

(51) Int. Cl.
*A41C 3/14* (2006.01)
*A41C 3/10* (2006.01)

(52) U.S. Cl. ..... 450/39; 450/54; 450/57

(58) Field of Classification Search ..... 450/36–39, 450/54–57, 92, 93; 2/267, 92, 26.8, 455, 2/463; 623/7, 8; 156/245; 264/257, 258, 264/291, 292, 294, 145, 148, 152–157, 160, 264/163, 554

See application file for complete search history.

(56) References Cited

U.S. PATENT DOCUMENTS

| | | | | |
|---|---|---|---|---|
| 4,080,416 | A * | 3/1978 | Howard | 264/258 |
| 5,733,335 | A * | 3/1998 | Ishikawa et al. | 623/7 |
| 6,042,608 | A * | 3/2000 | Ishikawa et al. | 623/7 |
| 6,986,696 | B1 * | 1/2006 | Jagaric et al. | 450/39 |
| 6,997,775 | B2 * | 2/2006 | Jagaric et al. | 450/57 |
| 7,044,829 | B1 * | 5/2006 | Jagaric et al. | 450/54 |
| 7,052,360 | B2 * | 5/2006 | Lau | 450/57 |

* cited by examiner

*Primary Examiner*—Gloria M. Hale
(74) *Attorney, Agent, or Firm*—Notaro & Michalos P.C.

(57) ABSTRACT

A method of manufacturing a breast-covering garment pad having a thicker summit area, as well as the pad itself, includes holding a sheet of resilient and formable material of uniform thickness, such as thermoplastic foam, and forming the sheet to have a graduated thicker summit area corresponding to each breast summit of the pad or a garment including the pad, and a surrounding thinner area. Each pad thus has a thicker summit area for extending over the nipples the breasts.

49 Claims, 10 Drawing Sheets

BREAST PAD CONSTRUCTION FOR A GARMENT

CROSS-REFERENCE TO RELATED APPLICATIONS

This is a continuation-in-part of application Ser. No. 11/054,185 filed Feb. 9, 2005 entitled BRA PAD CONSTRUCTION and now U.S. Pat. No. 6,997,775, which was a continuation-in-part of application Ser. No. 10/804,403 filed Mar. 19, 2004 entitled A BRASSIERE AND RELATED BREAST CUP CONSTRUCTION and now U.S. Pat. No. 7,052,360, and application Ser. No. 10/911,269 filed Aug. 4, 2004 entitled PADS HAVING A CENTRAL SUMMIT FOR BRAS AND THE LIKE and now U.S. Pat. No. 6,986,696, all of which are incorporated here by reference.

FIELD AND BACKGROUND OF THE INVENTION

The present invention relates generally to the field of bras and related garments, and in particular to a new and useful method and pad product having a thicker central summit area for use in bras, camisoles, slips, swimsuits or any other breast covering garment where padding is desired.

It is known to provide resilient pads in bras to accentuate the figure. Padded bras are not always desirable, however. Bras without pads are also known but these have limited ability to enhance the figure.

Recently, materials for the manufacture of brassieres have been developed that allow for more convenient manufacture of a brassiere. Traditionally the cup forms of a brassiere have, in order to introduce a three dimensional cup shape therein, consisted of several panels which have been sewn or otherwise affixed together. With the advent of moldable synthetic materials such as foam and synthetic fabric materials, cup forms are now moldable into a single panel of material or assembly of panels of materials to define the three dimensional cup form. The ability to mold material to define a cup form of a desirable shape has allowed the manufacturing process to be simplified or accelerated. As well as providing support to a breast of a wearer, the cup forms are often also required for additional benefits to the wearer.

Some women prefer that a brassiere conceals some if not all of the regions of the breasts. For modesty, it is desirable that the nipples of a wearer at all times remain unnoticeable from the exterior of the brassiere and any over garment that may be worn by the wearer. Molded cup forms of brassieres that are currently available generally do not provide for any enhancement to the cup form for such purpose. Molded cup forms are normally of a substantially even thickness across the body of the cup and while it may be possible to increase the thickness of the cup in order to thereby reduce the visibility of the nipples of a wearer to the exterior of the brassiere, such increasing thickness may add to the cost of manufacture of the brassiere. Furthermore it is undesirable for increased thickness of the brassiere to exist at its perimeter if the presence of the brassier entirely, is to be as unobtrusive as possible. It is desirable for the perimeter of the bra to be relatively thin so that it has the appearance of feathering in with the skin of the wearer.

The patent prior art contains various relevant examples.

U.S. Pat. No. 4,013,750 discloses a method for making brasserie pad pre-forms which can produce a bra pad having a thicker central region than its outer regions. A mold apparatus is utilized which produces a substantially conical pad of polyester fibers with a summit which is thicker than the periphery of the conical pad. Also see U.S. Pat. No. 3,947,207.

Other patents of interest to the present invention are:

| U.S. Pat. No. | Inventor(s) |
|---|---|
| 2,507,543 | Prager |
| 2,565,400 | Skeoch |
| 2,616,093 | Talalay |
| 2,627,368 | Jantzen |
| 2,702,769 | Alderfer |
| 2,845,974 | Ashton et al. |
| 3,164,655 | Howard et al. |
| 3,186,271 | Kaiser |
| 3,311,007 | McGee |
| 3,417,755 | Howard et al. |
| 3,464,418 | Silverman |
| 3,502,083 | Howard et al. |
| 3,800,650 | Schroder |
| 4,351,211 | Azzolini |
| 5,017,174 | Gowrylow |
| 5,299,483 | Ber-Fong. |

U.S. Pat. No. 2,627,368 to Jantzen discloses a method of making curved pad filler in which a mold is provided with a concave part for receiving a part of a blank of material. A means are provided for pushing or pressing the blank into the concave part of the mold. A sharp moving knife is passed between the mold and the pressing element, resulting in a curved shoulder pad filler and uniformly tapered portions extending from the thick end to a feathered edge.

U.S. Pat. No. 3,186,271 to Kaiser discloses an apparatus and method for producing shaped articles consisting of foam such as sponges and cushions.

Neither the Jantzen nor the Kaiser patents teach or suggest a sheet of material having a pair of thicker areas positioned so that they correspond to the location where the central summit of the bra pad will be when it is completed.

U.S. Pat. Nos. 3,164,655, 3,417,755 and 3,502,083 to Howard et al. disclose molding of a blank to give it a desired shape and contour but fail to teach or suggest forming a foam sheet of material having a pair of thicker areas positioned so that their position corresponds to the location where the central summit of the bra pad will be when it is completed after thermoforming.

U.S. Pat. No. 2,616,093 to Talalay discloses an apparel pad such as a shoulder or breast pad, which as a concavo-complex shape with a thickness graduated from a relatively thick portion to a relatively thin portion using different pieces of material to build up the pad.

U.S. Pat. No. 3,311,007 to McGee discloses an apparatus for producing at least one contoured surface upon a foamed material pad but is very different from the present invention because it teaches the effects of cutting a foam member which is compressed by a male mold portion against an opposite flat mold portion, and thus, the contour of the shaved material is based on the shape of the male mold portion. McGee fails to teach contouring of an article based on a foam material being pressed to cover and penetrate a recess before the foam material is shaved.

U.S. Pat. No. 2,727,278 to Thompson discloses a method of making a molded composite bra, in which the thickness of filler material in each bra pad has a summit thickness greater than the thickness surrounding the summit. The process for making the molded bra is however very different from the present invention and does not teach shaving a material compressed into a recess.

The remaining patents disclose other pad-related technology which are distinguishable from the invention, and they are enclosed for general reference.

A need remains for an improved pad, as well as a method for producing such a bra pad, which adds some padding effect to the bra but in a very subtle manner so that the padding is barely perceptible.

SUMMARY OF THE INVENTION

It is an object of the present invention to provide a method of manufacturing a bra pad having a thicker central summit area, as well as the pad itself and the apparatus for manufacturing the pad, comprising holding a sheet of uniform thickness, resilient and formable material, such as thermoplastic foam, and forming the sheet to have one or two thicker summit areas corresponding to the summits of the bra or bra-like garment (here called a bra for any garment in which the pads are ultimately used). Each pad thus has a thicker summit area for extending over the summits of the breasts of a wearer of the bra.

A further object of the invention is to provide the bra pad made in accordance with the method of the invention.

A further object of the present invention is to provide a bra or brassiere which includes molded cup forms which address the abovementioned limitations of the prior art or which will at least provide the public with a useful choice.

It is a further object of the present invention to provide a molded cup form for a brassiere including a laminated structure of a first panel of a flexible foam material and a second panel material, the first and second panels being substantially coextensive to each other and define a breast cup perimeter shape, wherein the first panel of flexible foam material is of varying thickness, providing a zone of greater thickness at a region or regions away from the perimeter as compared to regions of lesser thickness more proximate to the perimeter. Preferably the zone of greater thickness is located where, in use, a nipple of the wearer of the bra incorporating the breast cup is normally located.

Preferably the first panel is of a uniform thickness save for the zone of greater thickness, the zone of greater thickness having a maximum thickness at the center of the zone and being of a gradually reducing thickness toward the perimeter of the zone.

The second panel is disposed to the first major side of the first panel, to form a coextensive planar assembly which is molded to define a cup shape into the planar assembly and then any excess non-cup shape defined regions are removed from the assembly.

This invention may also be said broadly to comprise in the parts, elements and features referred to or indicated in this specification, individually or collectively, and any or all combinations of any two or more of said parts, elements or features, and where specific integers are mentioned herein which have known equivalents in the art to which this invention relates, such known equivalents are incorporated herein as if individually set forth. For the purposes of illustrating the invention, there is shown in the drawings a form which is presently preferred, it being understood, however, that this invention is not limited to the precise arrangements shown.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
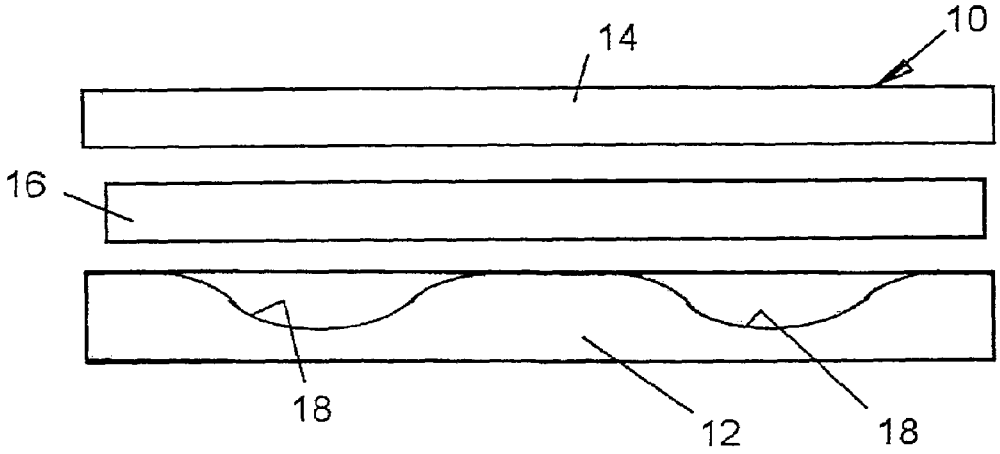
FIG. 1 is a side elevation view of an open shaving mold used to make the pads and to practice the method of the present invention with a sheet of polyurethane foam material therebetween.

Referring now to the drawings, in which like reference numerals are used to refer to the same or functionally similar elements, FIG. 1 shows a shaving mold generally designated 10 comprising a lower shaving mold portion 12 and an upper shaving mold portion 14 with a thickness of e.g. 7 mm polyurethane foam 16 therebetween. Although polyurethane foam is illustrated, any thermo plastic foam material can be used according to the present invention and in fact any formable material can be used which is resilient and is capable of being formed into a permanent yet resilient three-dimensional shape. The shaving mold halves or portions 12 and 14 can be made of wood, plastic, metal or other suitable rigid material. Lower mold half 12 contains a pair of recesses 18 in its upper surface which are positioned so that they are near the central summit of each bra pad to eventually be made in accordance with the present invention.

Figure 2:
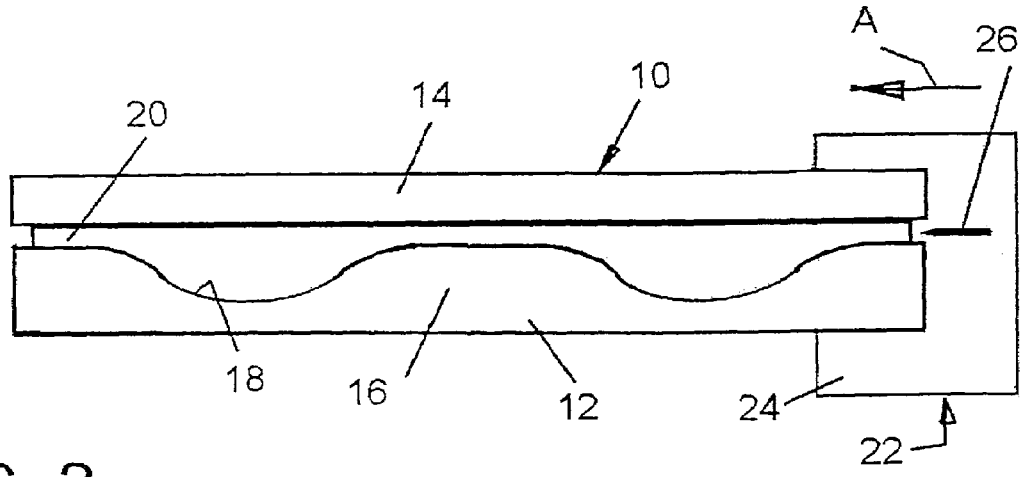
FIG. 2 is a view similar to FIG. 1 of the shaving mold in its closed position and with a shaving device in an initial position of use.

FIG. 2 illustrates the shaving mold in its closed position with the resilient formable sheet of material 16 pressed down onto the lower mold half so that some of the material of sheet 16 is pressed into each recess 18 but also a thickness of material, for example at 20, remains along the shaving mold halves.

A shaving apparatus generally designated 22 is also illustrated in FIG. 2 which comprises a movable carriage 24, which carries a blade, knife or shaving member 26 that extends transversely the full width of material sheet 16 (perpendicular to the plane of FIG. 2). Blade 26 is also positioned intermediate to the upper and lower shaving mold halves 14, 12 respectively so that a portion of the layer 20 can be neatly shaved from the sheet 16. For this purpose, member 26 may be heated (e.g., a cutting wire), may be mounted for movement like a band saw, may be reciprocally vibrated back and forth like an electric knife or oscillated in any other appropriate way for cutting the foam material of sheet 16.

Figure 3:
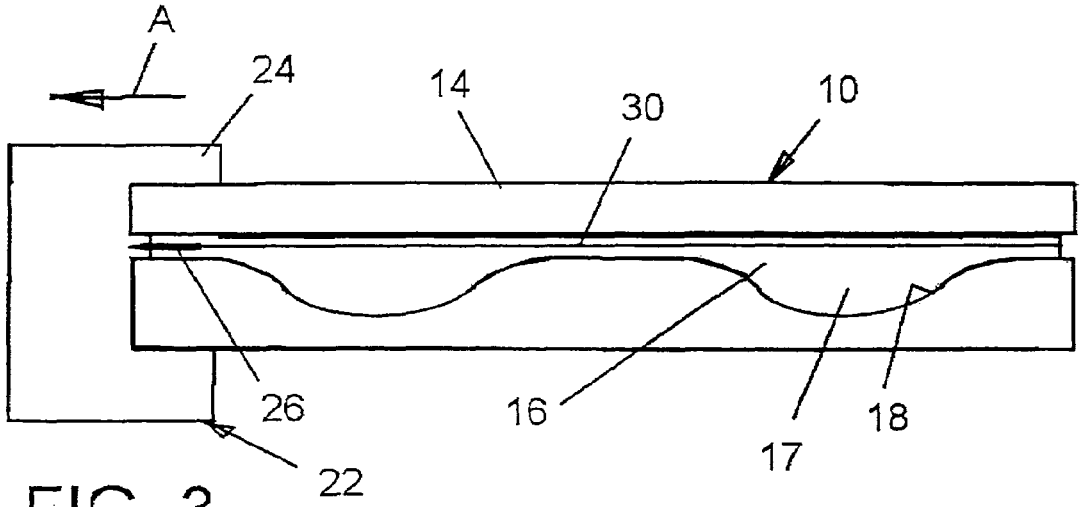
FIG. 3 is a view similar to FIG. 2 with the shaving apparatus in a final position.
Figure 4:
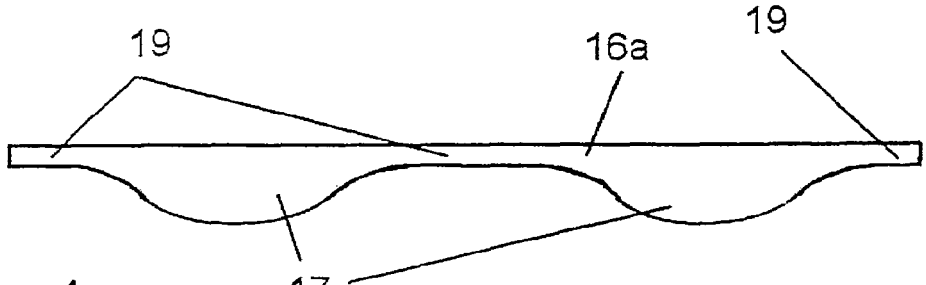
FIG. 4 is a side elevational view of a shaved or graduated sheet component of the bra pad in accordance with the present invention.
Figure 8:
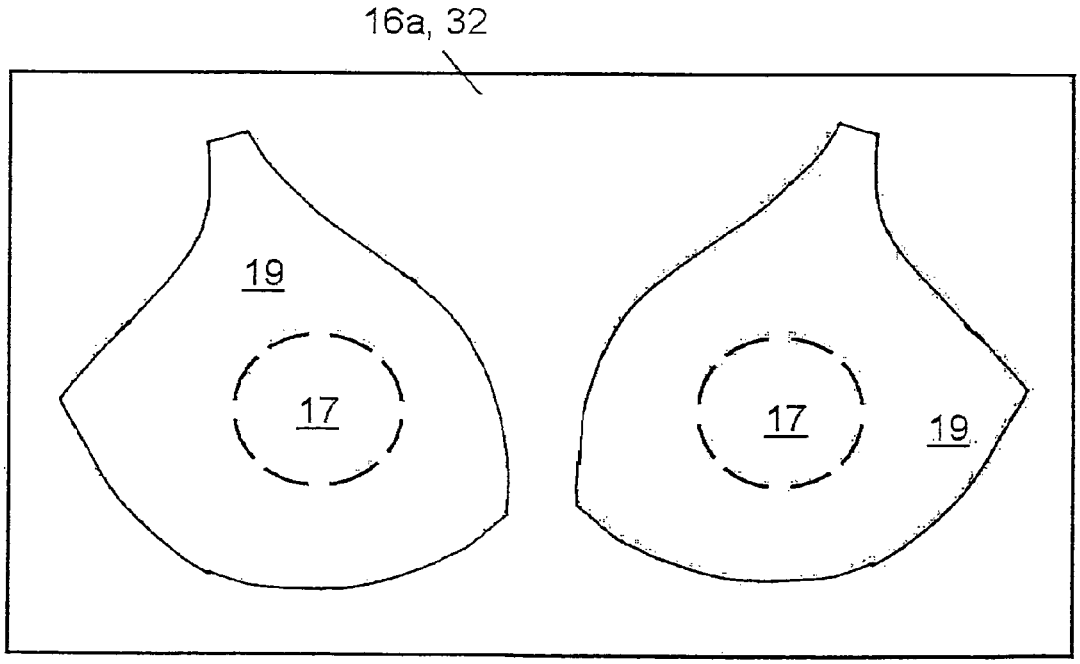
FIG. 8 is a top plan view of the formed component of FIG. 7.

With the shaving apparatus 22 activated to vibrate, heat or otherwise activate member 26, the carriage 24 is moved in the direction of arrow A and across the sheet 16 until it reaches its final position shown in FIG. 3. In this position a slice 30 has been made in sheet 16 thus achieving the shaving effect. FIG. 4 shows the shaved component or graduated sheet 16*a* which is removed from the shaving mold after it is opened and which contains a pair of thicker material areas 17 at a summit e.g. of 5.5 mm thickness, surrounded by thinner material areas 19, e.g. 1 mm thick. FIG. 8 illustrates in dotted line the two summit areas 17 on the rectangular and graduated sheet 16*a* which, in FIG. 8, has already been attached to as second outer cup sheet 32, e.g. 2 mm thick, shown in FIG. 5 which is also made of polyurethane foam material. Shaved or graduated sheet 16*a* forms an inner cup sheet.

Figure 5:
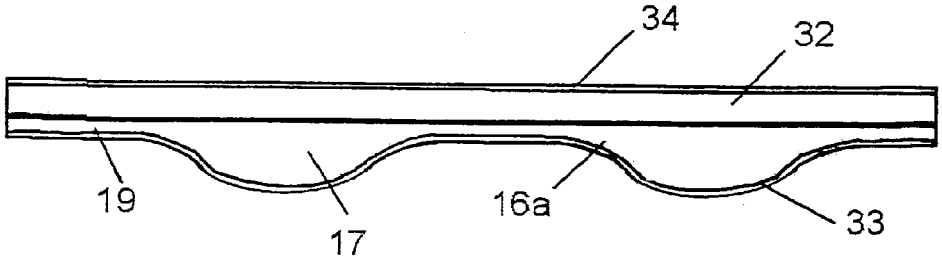
FIG. 5 is a view similar to FIG. 4 of an assembled pre-form of the bra pad according to the present invention.

As shown in FIG. 5, each of the cup sheets 16*a* and 32 may also include a laminate or fabric covering 33 and 34, respectively, made, for example, of nylon or nylon with spandex. This is a conventional covering for foam pads used in bras. It is important that in accordance with the present invention, the laminate 33 be on the outer inner surface of the inner cup sheet 16*a* so that it is not shaved away by the shaving apparatus 22 and that the outer cup sheet 32 have its laminate 34 on its outer surface. This leaves the inner surfaces of panels 16*a* and 32 free to receive sprayed on glue. After the glue is sprayed on the two surfaces are pressed against each other to produce the single composite pre-form illustrated in FIG. 5.

Figure 6:
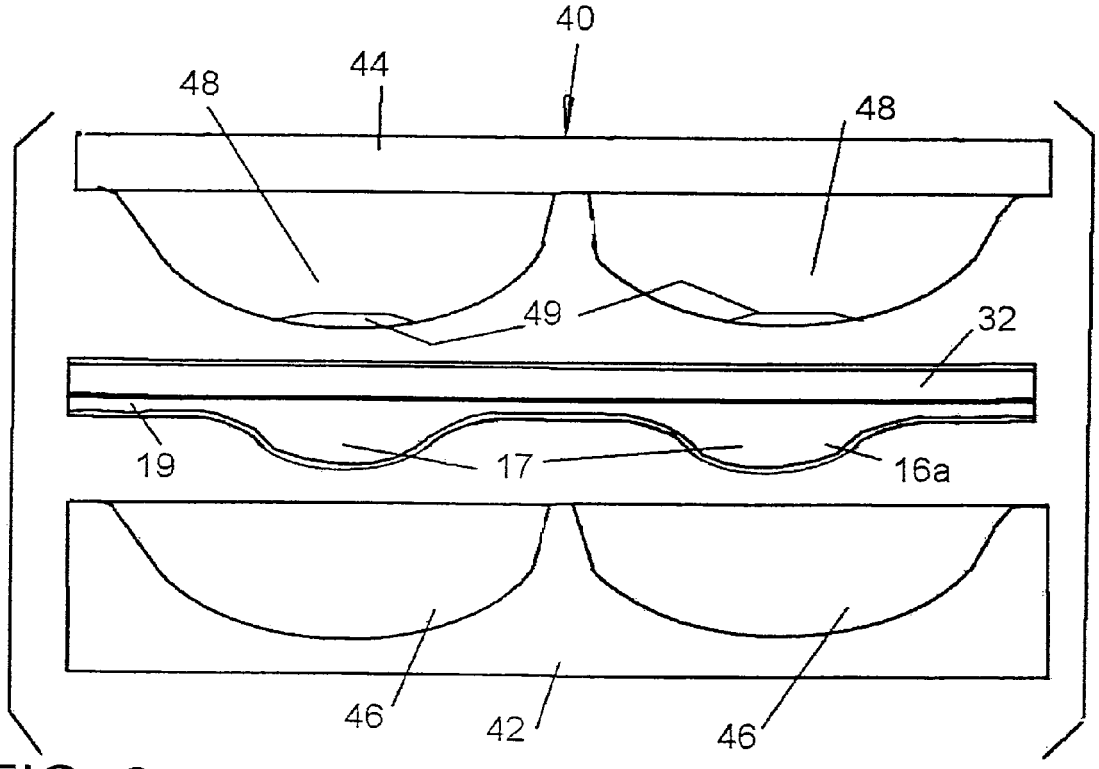
FIG. 6 is an exploded view of a forming mold with the pre-form bra pad between the mold halves thereof.

In FIG. 6 a thermo-forming mold 40 is generally designated 40 and, as illustrated, includes a lower female mold portion or half 42 and an upper mold half or portion 44. The pre-form 16*a*, 32 is positioned between the mold halves 42, 44 with the summits 17 centered on a pair of recesses 46 formed in the lower female mold half 42 which also correspond with a pair of male projections 48 formed in the male mold half 44. Each projection 48 may also include a slight recessed or flattened area 49 or an area which is shaped to keep from completely crushing the summit areas 17 of the inner cup sheet 16*a*.

Figure 7:
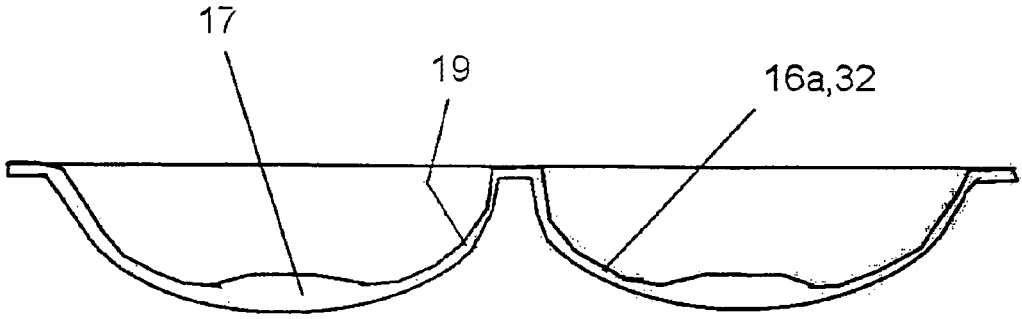
FIG. 7 is a sectional view of a formed component for creating two foam pads of the present invention.

The mold halves are heated to the appropriate level for molding the pre-form into a finished molding illustrated in FIGS. 7 and 8. The finished molding has thicker summit areas 17, e.g. 5-6 mm thick, surrounded by the thinner surrounding areas 19, e.g. 1 mm thick, which completely encircle each summit area 17 and have an inner area of e.g. 2 mm thick, so that a bra manufactured with or containing the bra pads of the present invention will have a slightly thicker area 17, for example 3 mm, over the summit of each breast summit, and thinner material, e.g. tapering down to 1 mm, in thinner areas 19.

Figure 9:
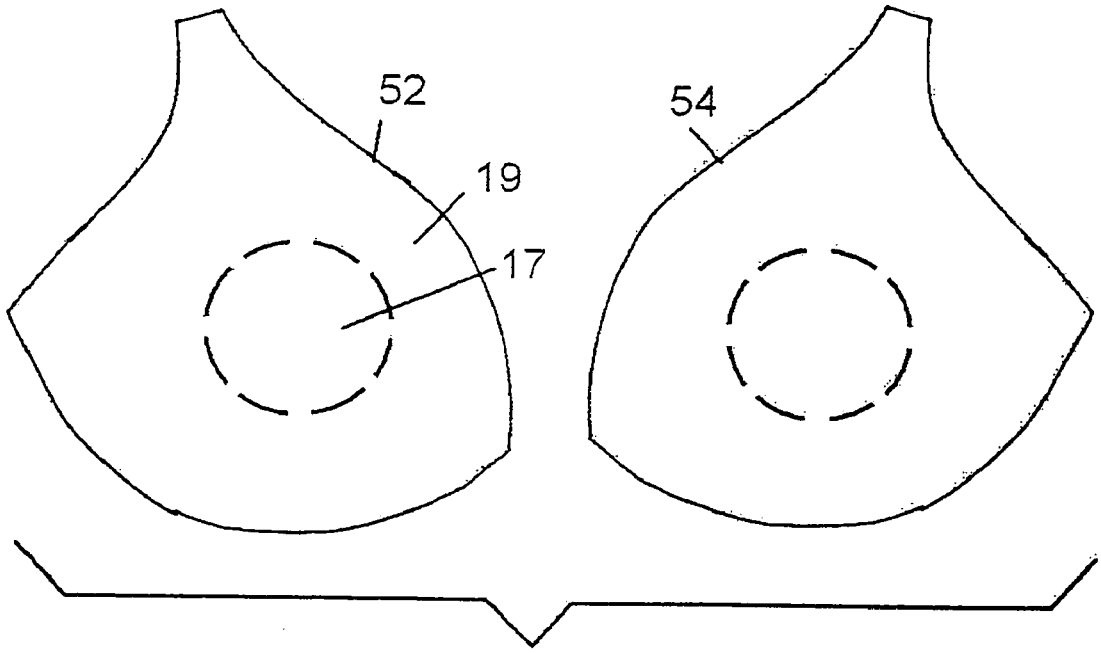
FIG. 9 is a view of a pair of bra pads constructed in accordance with the present invention.

FIG. 9 illustrates the pair of pads 52, 54 which are cut from the molding of FIGS. 7 and 8 and are ready for use in a bra, in a conventional manner. The pads 52, 54 may also be used in other garments for covering the torso of a woman and which contain bra or bra-like structures such as bathing suits, camisoles, and the like.

Figure 16:
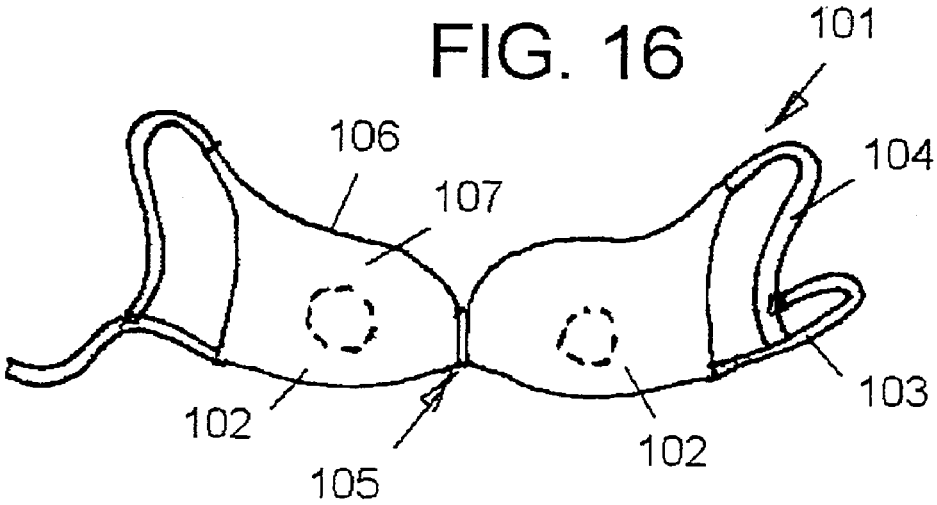
FIG. 16 is a perspective view of a brassiere incorporating the cup forms of the invention.

With reference to FIG. 16 there is shown a bra or brassiere 101 including two breast cup constructions 102 which have been engaged to various other components of the brassiere 101 such as for example body straps 103 and over the shoulder straps 104.

The breast cups 102 are engaged together at an intermediate connection 105. The breast cups have a perimeter 106 and a body portion 107 inward of the perimeter 106. The breast cup is of a form having been molded and to a large extent is of a single structure comprising or consisting of a plurality of overlying and preferably substantially coextensive panels defining the assembly of the cup form. It is however envisaged that the breast cup of the present invention may have disposed therefrom or engaged thereto by means of sewing or otherwise affixing additional panels which may extend from the perimeter 106 of the cup form or may be associated with the cup form 102 intermediate of the perimeter 106 and define part of the body portion 107 of the cup form.

The two breast cups 102 of the brassiere are substantial mirror image about the intermediate connection 105. Reference has been and will now be made to a single breast cup formed or to be formed from precursor materials, however, it will be appreciated that such reference is also reflective of the provision of the same form of breast cup for the other cup to be incorporated into a brassiere.

Figure 13:
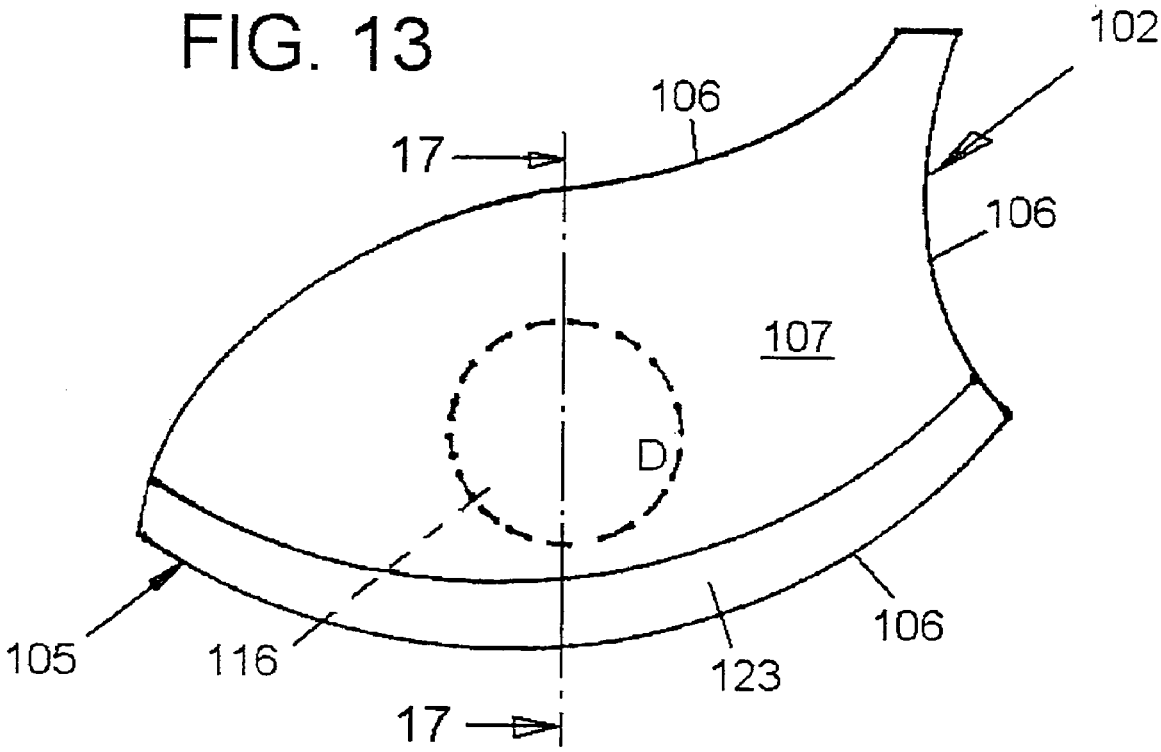
FIG. 13 is a plan view of a cup form having been molded and trimmed to define a perimeter suitable for incorporation as part of a brassiere.

With reference to FIG. 13, there is shown a breast cup 102. The breast cup is molded to a three dimensional form, such as a cup form appropriate for the purpose of supporting and covering at least part of the breast of the wearer. The breast cup 102 has been molded from materials which, with reference to FIG. 10, may include a first panel of flexible foam material 108, preferably a second panel of flexible foam material 109, a covering panel of flexible fabric material 110 and a second panel of covering flexible fabric material 111. In an alternative form however as for example shown in FIG. 14, the breast cup may be defined by a first panel of flexible foam material 108, the covering flexible fabric material 110 and the second panel of covering flexible material without there being a provision of a second panel of flexible foam material 109.

While reference herein is made to such panels being directly affixed to each other preferably by laminating such as by heat and/or adhesive laminating, it will be appreciated that panels or panel assemblies consisting of plies of sheet material may be provided intermediate of those panels.

Figure 10:
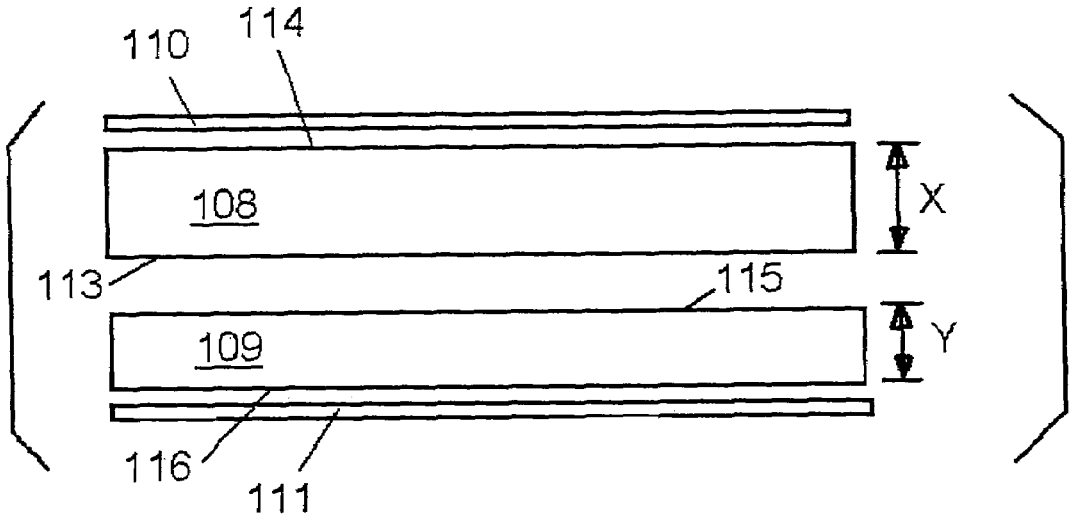
FIG. 10 is an exploded sectional view through an assembly of panels prior to being formed and laminated together for the purposes of providing the bra cup, according to another embodiment of the present invention.

With reference to FIG. 10, there is shown a sectional view of the panels of the breast cup of the present invention consisting of a first panel of a flexible foam material 108 and a second panel of a flexible foam material 109. Disposed and preferably substantially coextensive with the first panel of foam material 108 there is provided a panel of flexible fabric material 110. The laminated assembly of the panel 108 and 110 may be provided from roll stock material to be used in the method of the present invention. The fabric material 110 may for example be nylon and the foam material may for example be polyurethane. The foam panel 109 includes a first major surface 113 which is exposed and a second major surface 114 against which the fabric panel 110 is laminated. In this precursor form of the assembly of panel 108 and 110, such an assembly is in an unmolded condition and in a natural state assumes a flat or planar condition.

A second panel of flexible foam material 109 in assembly for example with a second panel of flexible fabric material 111 is also provided. The second panel of foam material 109 includes an exposed major surface 115 and a covered major surface 116 against which the second flexible fabric panel is laminated. Like the assembly of panels 108 and 110, the panels 109 and 111 may be provided in a precursor form from a feed of roll stock and in a natural state assume a substantially planar or flat condition.

The size of the resulting rectangular cut precursor panel assemblies is such that when subjected to molding in a molding machine to define the three dimensional cup form thereof, it is of a sufficiently large size to define the entire desired cup form. The first panel of foam material 108 is preferably of a greater thickness X than the thickness Y of the second panel of foam material 109.

Figure 11:
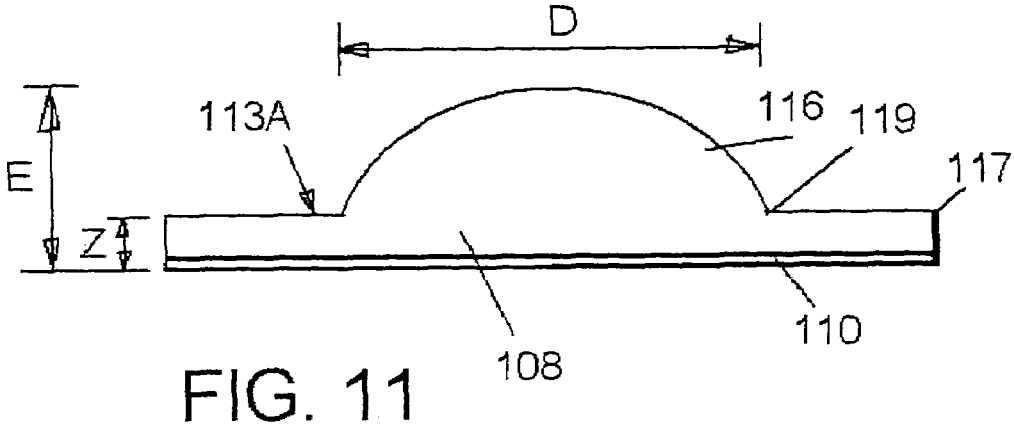
FIG. 11 is a sectional view through an assembly of panels of FIG. 10, prior to being molded.

With reference to FIG. 11, the first panel of foam material 108 is formed to define a zone of increased thickness 116. This zone of increased thickness 116 is provided intermediate of the perimeter 117 of the assembly of panels 108, 110. The zone of increased thickness 116 is also provided inward (inward of the perimeter) of that region of the panel assembly 108, 110 into which a molded cup form to ultimately define a breast cup of the present invention will be defined.

Accordingly when formed to a cup form with the other panels to define the breast cup of the present invention as shown in FIG. 13, the zone of increased thickness 116 is provided inward from the perimeter 106 of the breast cup. In the preferred form the first panel of flexible foam material prior to being molded is formed to be of a substantially constant thickness Z save for the zone of increased thickness 116. In the most preferred form such contouring is by the shaving of the panel to define the contoured shape on the first major side 113 of the precursor panel of flexible foam material 108 as disclosed in greater detail above.

After having been formed/shaped the then contoured first major surface 113A of the first panel of flexible foam material 108 will include the zone of increased thickness 116 extending from regions of reduced thickness at or towards the perimeter of the panel assembly 108, 110. The zone of increased thickness may for example be a dome shape as for example shown in FIG. 11 and of a constant diameter D.

Figure 14:
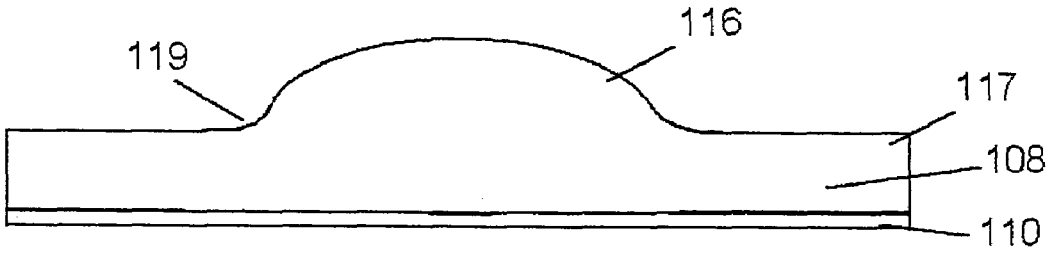
FIG. 14 is a sectional view through an alternative configuration of an assembly of panels to that of FIG. 11.

Alternatively the shape may be of a gradually undulation as for example shown in FIG. 14. So that the existence of this zone of increased thickness in the final version of the brassiere is to a large extent disguised, it is preferred that the zone of increased thickness 116 has a maximum thickness or summit substantially centrally within the zone and provides a reduction in thickness towards the perimeter 119 of the zone. Such reduction in thickness may be by a linear tapering, for example, shown in FIG. 14. In the most preferred form the second panel of flexible foam material 109 is not subjected to any contouring. The first panel of flexible foam material 108 is subjected to contouring but only on the non-fabric side of the first panel, opposite to panel 110.

Figure 12:
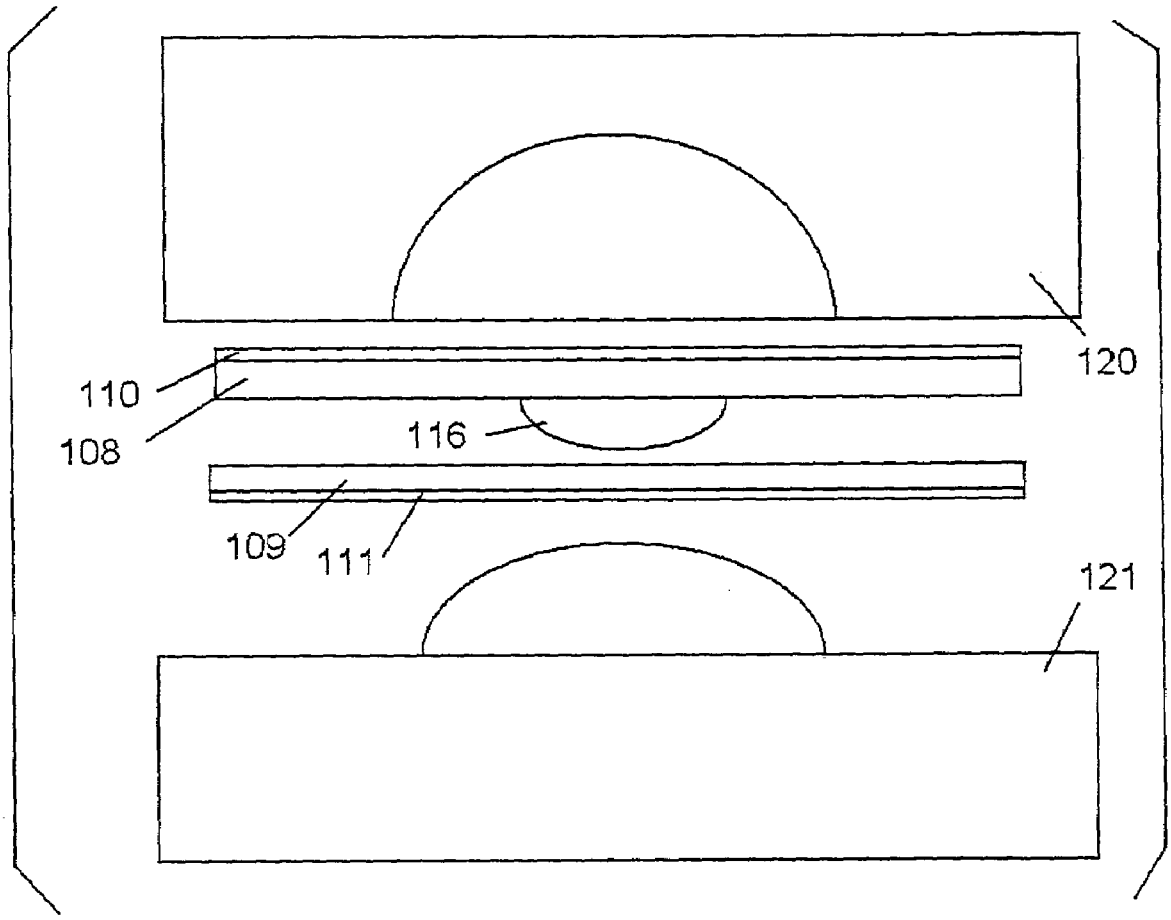
FIG. 12 illustrates two panel assemblies of the invention, prior to being laminated together and prior to being formed into a three dimensional cup form by molding elements.

The assembly of panels 108, 110 is then laminated with the assembly of panels 109, 111 in a molding device as for example shown in FIG. 12. The molding device consists of two mold portions 120 and 121 each having formed therein a profile or contour of a kind to introduce into the precursor assemblies of panels the three dimensional or cup form of the breast cup. The upper mold portion 120 for example includes a concave relief and the lower portion 121 provides a convex upstand of a substantially complimentary shape to the concave recess of the upper mold portion 120.

The assemblies of panels 108, 110 and 109, 111 are positioned intermediate of the mold portions in a manner so that they overly each other in an appropriate condition (preferably coextensively) whereupon the two mold portions are then brought together. The two mold portions are preferably heated. Additional adhesive may be placed intermediate of the assemblies so that both pressure adhesive and heat will ensure that a good laminated bond can be established between the two subassemblies. Upon the formation of the cup form into the precursor panel or panel assemblies, the cup form can be trimmed from the molded precursor panels to define a perimeter shape such as for example shown in FIG. 13. Part of the perimeter of the cup form 106 may include an additional compression zone 123 where the overlying panels of material have been subjected to more enhanced compression than that of the main body portion 107. Such additional compression zones may serve the purpose of allowing for the cup to define a flange useful for the purposes of securing the cup to other components of the brassiere.

With reference to FIG. 13, it can be seen that upon the forming of a three dimensional form or cup form in the precursor materials as well as laminating the precursor materials together, will locate the zone of increased thickness 116 inward from the perimeter 106 of the breast cup 102. The zone of increased thickness 116 is provided within the body portion 107 of the breast cup 102. This zone of increased thickness is positioned to correspond with the usual location of the nipple of the breast of a wearer of a brassiere incorporating the breast cup 102.

Figure 17:
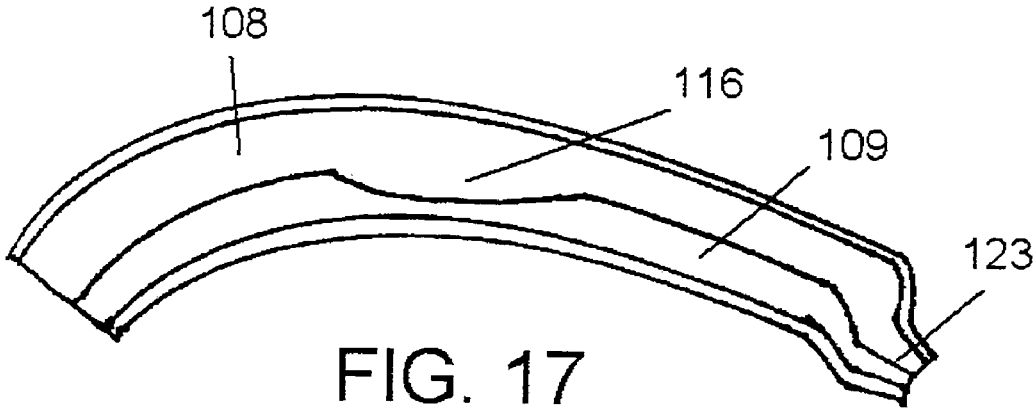
FIG. 17 is a sectional view through section 17-17 of FIG. 13 wherein the assembly of panels according to that shown in FIG. 12 is provided.

With reference to FIG. 17 there is shown a cross sectional view through section 17-17 of FIG. 13 wherein the zone of increased thickness 116 is shown to be provided to enhance the overall thickness of the breast cup in such zone. Thickness B is greater than thickness C. While the thickness is perhaps only marginally greater at B than at C, a further enhancement to reduce the visibility of a nipple of a wearer through the breast cup is as a consequence of the higher density of material at the zone of increased thickness 116. Once the breast cup has been formed, the zone of increased thickness 116 will compress slightly such compression enhancing the material density at this zone thereby reducing the likelihood of observing the presence of the nipple through the breast cup. In the preferred form the thickness E is substantially the same as the thickness X and accordingly at the region of maximum thickness of the zone of increased thickness 116, little or no shaving or removal of the foam from the precursor precontoured panel of flexible foam material 8 has occurred.

Figure 15:
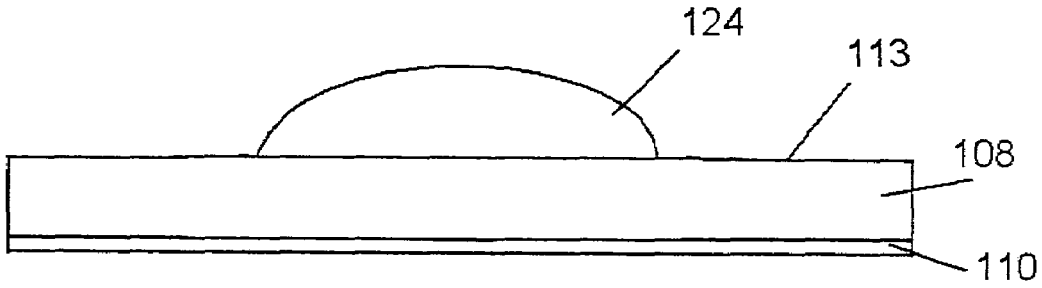
FIG. 15 is an alternative to FIG. 14.

With reference to FIG. 15, there is shown an alternative to the formation of the zone of increased thickness 116 wherein a first ply of foam material has engaged to its exposed major surface 113 a second ply of material 124 such as a like foam material which has been contoured to provide the same desired profile to the assembly of the first ply and the second ply 124 as that shown for example in FIG. 11 or 14.

Figure 18:
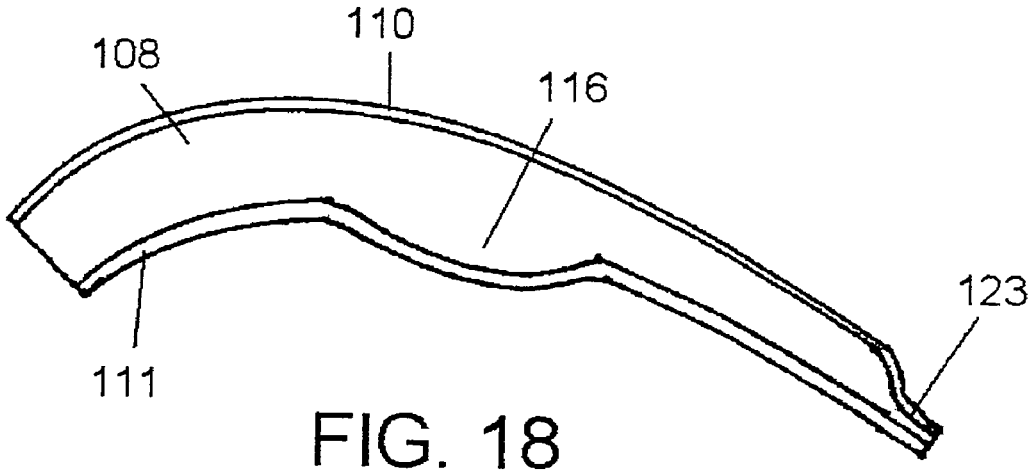
FIG. 18 is a sectional view through section 17-17 of FIG. 13 wherein an assembly of panels as shown in FIG. 14 is provided.

While in the most preferred form, the second assembly consisting of the second panel of flexible foam material 109 and panel of fabric material 111 laminated by adhesion to the first panel of foam material, with reference to FIG. 18 there is an alternative where the first panel 108 receive the flexible panel of fabric material 111, directly engage without the presence of a second panel of foam material 109 being present. An assembly of such a configuration formed to a cup form is shown in FIG. 18.

While a specific embodiment of the invention has been shown and described in detail to illustrate the application of the principles of the invention, it will be understood that the invention may be embodied otherwise without departing from such principles.

What is claimed is:

1. A method of manufacturing a breast pad for a garment for at least partly covering a breast of a wearer, comprising:

providing a first mold having at least one graduated recess;

holding a first sheet of resilient and formable material having a uniform thickness in the first mold with at least some of the material in at least one graduated recess of the first mold;

removing some of the resilient and formable material from the first sheet by shaving or cutting to leave a graduated sheet of the material having at least one graduated thicker summit area of the graduated sheet corresponding to the graduated recess of the first mold and a surrounding thinner area of the graduated sheet corresponding to the first mold around the graduated recess;

adhering to the graduated sheet opposite a surface of the graduated sheet from which the at least one graduated thicker summit area protrudes, a further sheet of resilient and formable material using adhesive to create a breast pad component; and cutting the breast pad component to a desired pattern which includes at least one graduated thicker summit area to obtain the breast pad.

2. A method according to claim 1, wherein the material of the first sheet is thermo-formable material.

3. A method according to claim 1, wherein the cutting step comprises cutting the breast pad component around at least one graduated thicker summit area and or around a perimeter of the breast pad component.

4. A pair of breast pads for a garment for at least partly covering breasts of a wearer, comprising:

a first sheet of resilient and formable material having an initial uniform thickness and from which some material of the first sheet has been removed by shaving or cutting to leave a graduated sheet of the material having two graduated thicker summit areas, and a surrounding thinner area; and a further sheet of resilient and formable material adhered by adhesive to the graduated sheet of resilient and formable material opposite a surface of the graduated sheet from which the thicker summit areas protrude forming two breast pads each with one of the thicker summit areas, wherein the surrounding thinner area is adjacent the two graduated thicker summit areas and has a lesser thickness relative to the two graduated thicker summit areas.

5. A pad according to claim 4, where each of the first sheet and further sheet of resilient and formable material are made of thermoplastic foam and have one laminated surface and an opposite surface adhered to the other sheet of material.

6. A pad according to claim 5, wherein the sheets of resilient and formable material each comprise thermoplastic material.

7. A pad according to claim 6, wherein the thermoplastic material is polyurethane foam.

8. A breast pad for a garment for at least partly covering breasts of a wearer, comprising:

a first sheet of resilient and formable material having an initial uniform thickness and from which some material of the first sheet has been removed by shaving or cutting to leave a graduated sheet of the material having at least one graduated thicker summit area, and a surrounding thinner area; and a further sheet of resilient and formable material adhered by adhesive to the graduated sheet of resilient and formable material with a fabric laminate on outer surfaces of each sheet of material which is opposite from a surface at which the sheets of material are adhered to each other, wherein the surrounding thinner area is adjacent the graduated thicker summit area and has a lesser thickness relative to the graduated thicker summit area.

9. A pad according to claim 8, wherein the material of the first sheet is thermo-formable material.

10. A method of manufacturing a breast pad for a garment that at least partly covers the breasts of a wearer with the breast pad, the method comprising:

providing a shaving mold having at least one recess;

holding a sheet of resilient and formable material having a uniform thickness in the shaving mold, with at least some of the material in at least one recess of the shaving mold; and removing some of the material from the sheet of resilient and formable material by shaving across a top surface of the shaving mold, to leave a graduated sheet of the material having at least one graduated thicker summit area corresponding to the recess of the shaving mold, and a surrounding thinner area of the graduated sheet corresponding to the shaving mold around the graduated area, wherein the at least one graduated recess of the shaving mold is constructed to impart a desired shape to the at least one graduated thicker summit area.

11. A method according to claim 10, wherein the material of the sheet is thermo-formable material, the method including thermo-forming the graduated sheet.

12. A method according to claim 10, including cutting a pad out of the graduated sheet by cutting some of the surrounding thinner area of the graduated sheet adjacent at least one summit area to a desired pattern.

13. A method according to claim 10, wherein the shaving mold has two recesses which are constructed to impart the graduated sheet with a pair of spaced apart summit areas.

14. A method according to claim 10, including adhering to the graduated sheet opposite a surface of the graduated sheet from which the at least one graduated thicker summit area protrudes, a further sheet of resilient and formable material and then forming the graduated sheet with the adhered further sheet of material to form a pad with the adhered further sheet of material.

15. A method according to claim 10, wherein the removing of material by the shaving step comprises passing a cutting tool spaced above the top surface of the shaving mold across the sheet of resilient and formable material having a uniform thickness, while the sheet is held in the shaving mold with at least some of the material in the at least one recess of the shaving mold.

16. A breast pad component for a garment for at least partly covering breasts of a wearer, the component comprising:

a first sheet of resilient, gel-free and formable material having an initial uniform thickness and from which some material has been removed by shaving or cutting to leave a graduated sheet of the material having at least one graduated thicker summit area, and a surrounding thinner area; and a further sheet of resilient, gel-free and formable material adhered to the graduated sheet of resilient and formable material to form a breast pad component that is free of gel and that includes the at least one graduated thicker summit area surrounded by the thinner area.

17. A breast pad component according to claim 16, wherein the sheets of resilient and formable material each comprise thermoplastic material.

18. A breast pad component according to claim 17, wherein the thermoplastic material is polyurethane foam.

19. A breast pad component according to claim 16, wherein the further sheet of resilient and formable material adhered to the graduated sheet of resilient and formable material has a fabric laminate on outer surfaces of each sheet of material which is opposite from a surface at which the sheets of material are adhered to each other.

20. A molded breast cup for a garment including a molded cup form and laminated structure of a first panel of a flexible foam material and a second panel of flexible material, said first and second panels being substantially coextensive to each other and have a common breast cup outer perimeter edge, wherein said first panel of flexible foam material is of varying thickness, providing a zone of greater thickness at a region or regions away from said perimeter edge more than regions of lesser thickness more proximate to said perimeter edge, said first panel having said varying thickness introduced by a contouring of a first surface thereof, an opposite second surface thereof being uncontoured other than having been formed to said perimeter edge.

21. A molded breast cup as claimed in claim 20, wherein said first panel is a flexible foam material.

22. A molded breast cup as claimed in claim 20, wherein said second panel is a flexible fabric material.

23. A molded breast cup as claimed in claim 20, wherein said zone of greater thickness is located where, in use, a nipple of the wearer of the garment incorporating said breast cup is normally located.

24. A molded breast cup as claimed in claim 20, wherein the thickness of a region of said first panel outside said zone of greater thickness is uniform.

25. A molded breast cup as claimed in claim 24, wherein a transition of thickness between said zone of greater thickness and said uniform thickness region of said first panel of flexible foam material is a gradual thickness change.

26. A molded breast cup as claimed in claim 20, wherein a region of said first panel outside said zone of greater thickness has a uniform thickness, the zone of greater thickness having a maximum thickness and being of a gradually reducing thickness towards, a perimeter of the zone.

27. A molded breast cup as claimed in claim 20, wherein said first surface of said first panel is disposed to the second panel.

28. A molded breast cup as claimed in claim 20, wherein said first surface of said first panel is engaged to the second panel.

29. A molded breast cup as claimed in claim 20, wherein said first panel is engaged to the second panel.

30. A molded breast cup as claimed in claim in 20, wherein said first and second panels form a cup shaped cavity adapted to cover at least part of a breast, and wherein the first and second panels are arranged one over the other in overlapping relation.

31. A molded breast cup for a garment including a molded cup form and laminated structure of a first panel of a flexible gel-free foam material and a second panel of a flexible gel-free material, said first and second panels being substantially coextensive to each other and have a common breast cup outer perimeter edge, wherein said first panel of flexible foam material is of varying thickness, providing a zone of greater thickness at a region or regions away from said perimeter edge more than regions of lesser thickness more proximate to said perimeter edge, said first panel consisting of a first ply of foam gel-free material and a second ply of gel-free material engaged therewith in a manner to create said zone of greater thickness.

32. A molded breast cup as claimed in claim 31, wherein said second ply is of a foam material.

33. A molded breast cup as claimed in claim 31, wherein a first panel of fabric material overlies one of the first panel of flexible gel-free foam material and the second panel of flexible gel-free material, wherein the first and second panels of flexible gel-free material form a cup shaped cavity adapted to cover at least part of a breast.

34. A molded breast cup as claimed in claim 33, wherein a second panel of fabric material overlies the other one of the first panel of flexible gel-free foam material and the second panel of flexible gel-free material.

35. A molded breast cup as claimed in claim in 31, wherein said first and second panels form a cup shaped cavity adapted to cover at least part of a breast, and wherein the first and second panels are arranged one over the other in overlapping relation.

36. A garment incorporating a breast cup as claimed in claim 31.

37. A method of forming a molded breast cup comprising:

laminating (a) a first planar panel of a first ply of flexible foam material and a second ply of flexible foam material engaged to a first major side of said first ply said first panel is of varying thickness such having been defined by the provision of said second ply to said first ply to create a zone which is of greater thickness at a region or regions away from a perimeter edge of said first panel more than at regions of lesser thickness more proximate to said perimeter, with (b) a second panel of flexible material wherein said second panel is disposed to the first major side of said first panel, to form a coextensive planar assembly;

molding said planar assembly to form a cup shaped cavity adapted to cover at least part of a breast into said planar assembly; and removing any excess non cup shape defined regions from said assembly.

38. A molded and gel-free breast cup for a garment, the breast cup comprising:

a molded gel-free cup-shaped and laminated structure of a first gel-free panel of a flexible foam material and a second gel-free panel of flexible material, said first and second panels being substantially coextensive to each other and have a common breast cup perimeter edge;

said first panel of flexible foam material being of varying thickness, providing a zone of greater thickness at a region away from said perimeter edge more than regions of lesser thickness more proximate to said perimeter edge, said zone of greater thickness being located where, in use, a nipple of a wearer of said brassiere incorporating said breast cup is located and wherein said zone of greater thickness has a greater density than elsewhere in the breast cup.

39. A molded breast cup as claimed in claim 38, wherein said second panel is a flexible foam material.

40. A molded breast cup as claimed in claim 38, wherein said second panel is a flexible fabric material.

41. A molded breast cup as claimed in claim 38, wherein a region of said first panel outside said zone of greater thickness has a uniform thickness.

42. A molded breast cup as claimed in claim 38, wherein a region of said first panel outside said zone of greater thickness has a uniform thickness, the zone of greater thickness having a maximum thickness at the center of said zone and being of a gradually reducing thickness towards a perimeter of the zone.

43. A molded breast cup as claimed in claim 38, wherein a transition of thickness between said zone of greater thickness and said uniform thickness region of said first panel of flexible foam material is a gradual thickness change.

44. A molded breast cup as claimed in claim 38, wherein said first panel has said varying thickness introduced by a contouring of a first surface thereof, a second opposite surface thereof being uncontoured other than having been formed to said perimeter edge.

45. A molded breast cup as claimed in claim 44, wherein said first surface of said first panel is disposed to the second panel.

46. A molded breast cup as claimed in claim 38, wherein said first panel is engaged to the second panel.

47. A molded breast cup as claimed in claim 38, wherein said first panel consists of a first ply of foam material of a uniform thickness and a second ply of material engaged therewith in a manner to create said zone of greater thickness.

48. A molded breast cup as claimed in claim 38, wherein a panel of fabric material overlies one of the first gel-free panel of flexible foam material and the second gel-free panel of flexible material.

49. A molded breast cup as claimed in claim 38, wherein said first and second panels form a cup shaped cavity adapted to cover at least part of a breast and wherein said first and second panels are arranged one over the other in overlapping relation.

* * * * *